US007330098B2

(12) United States Patent
Yoshikawa

(10) Patent No.: US 7,330,098 B2
(45) Date of Patent: Feb. 12, 2008

(54) THERMAL FUSE EMPLOYING A THERMOSENSITIVE PELLET

(75) Inventor: Tokihiro Yoshikawa, Koka (JP)

(73) Assignee: NEC SCHOTT Components Corporation, Koka-shi (JP)

( * ) Notice: Subject to any disclaimer, the term of this patent is extended or adjusted under 35 U.S.C. 154(b) by 211 days.

(21) Appl. No.: 11/203,079

(22) Filed: Aug. 12, 2005

(65) Prior Publication Data

US 2006/0208845 A1 Sep. 21, 2006

(30) Foreign Application Priority Data

Mar. 17, 2005 (JP) ..... 2005-076484

(51) Int. Cl.
*H01H 85/06* (2006.01)
*H01H 85/055* (2006.01)

(52) U.S. Cl. ..... 337/416; 337/401; 337/407

(58) Field of Classification Search ..... 337/227, 337/297, 232, 166, 159, 160, 298, 401–405, 337/407, 290, 296, 416, 237; 29/623
See application file for complete search history.

(56) References Cited

U.S. PATENT DOCUMENTS 3,180,958 A * 4/1965 Merrill ..... 337/409
3,281,559 A * 10/1966 Ebensteiner ..... 337/403
3,529,270 A 9/1970 Kozacka
3,727,164 A * 4/1973 Cartier et al. ..... 337/405
3,781,737 A 12/1973 Henry
3,815,071 A 6/1974 Sleeter
3,930,215 A 12/1975 Senor
4,001,754 A * 1/1977 Plasko ..... 337/407
4,065,741 A 12/1977 Sakamoto et al.
4,068,204 A 1/1978 Iwanari et al.
4,084,147 A * 4/1978 Mlyniec et al. ..... 337/407
4,184,139 A 1/1980 Hara
4,189,697 A 2/1980 Hara
4,259,656 A * 3/1981 Smith ..... 337/407
4,276,531 A * 6/1981 Davis ..... 337/407

(Continued)

FOREIGN PATENT DOCUMENTS

DE 24 57 223 10/1975

(Continued)

OTHER PUBLICATIONS

U.S. Appl. No. 11/229,489, filed Sep. 15, 2005, Yoshikawa et al.

*Primary Examiner*—Anatoly Vortman
*Assistant Examiner*—Bradley H Thomas
(74) *Attorney, Agent, or Firm*—W. F. Fasse; W. G. Fasse

(57) ABSTRACT

There is provided a thermal fuse employing a thermosensitive pellet that reacts to an operating temperature with limited variation, and operates with high precision and hence high reliability. To achieve this, the thermal fuse includes a switching function member including a thermosensitive pellet, a movable conductor, and a spring member. At a prescribed operating temperature the thermosensitive pellet softens or melts to liberate the spring member from a load to cause the spring member to move the movable conductor to switch an electrical circuit located between first and second lead members. The thermosensitive pellet is formed of a thermosensitive material selected depending on a characteristic in flowability presented as it softens or melts.

4 Claims, 2 Drawing Sheets

U.S. PATENT DOCUMENTS

| | | | | |
|---|---|---|---|---|
| 4,276,532 | A | 6/1981 | Aoki | |
| 4,281,309 | A | 7/1981 | Olson | |
| 4,286,248 | A | 8/1981 | Hara | |
| 4,322,705 | A | 3/1982 | Hara | |
| 4,384,267 | A | 5/1983 | Aoki | |
| 4,480,247 | A | 10/1984 | Hara | |
| 4,514,718 | A | 4/1985 | Birx | |
| 4,529,957 | A | 7/1985 | Hara | |
| 4,630,023 | A | 12/1986 | Gawron et al. | |
| 4,821,010 | A | 4/1989 | Plasko | |
| 4,973,932 | A | 11/1990 | Krueger et al. | |
| 5,357,234 | A | 10/1994 | Pimpis et al. | |
| 5,473,303 | A | 12/1995 | Hohider | |
| 5,532,030 | A * | 7/1996 | Hirose et al. | 428/35.7 |
| 5,612,663 | A | 3/1997 | Hollweck | |
| 6,440,492 | B1 * | 8/2002 | Coran | 427/195 |
| 6,673,257 | B1 | 1/2004 | Hudson | |
| 6,710,310 | B2 * | 3/2004 | Hantz | 219/494 |
| 6,982,112 | B2 * | 1/2006 | Coran | 428/122 |
| 2003/0112117 | A1 * | 6/2003 | Miyashita et al. | 337/407 |
| 2003/0220460 | A1 * | 11/2003 | Merfled | 526/347.2 |
| 2005/0088272 | A1 | 4/2005 | Yoshikawa | |
| 2005/0179516 | A1 | 8/2005 | Yoshikawa | |

FOREIGN PATENT DOCUMENTS

| | | | |
|---|---|---|---|
| EP | 1 120 432 | | 8/2001 |
| EP | 1 308 974 | | 5/2003 |
| GB | 2 011 724 | | 7/1979 |
| JP | 50-138354 | | 11/1975 |
| JP | 51-145538 | | 11/1976 |
| JP | 52-144046 | | 12/1977 |
| JP | 57-094142 | | 6/1982 |
| JP | 57-103647 | | 6/1982 |
| JP | 57-140034 | | 9/1982 |
| JP | 60-138819 | | 7/1985 |
| JP | 62-246217 | | 10/1987 |
| JP | 02-281525 | | 11/1990 |
| JP | 05-135649 | | 6/1993 |
| JP | 05-307925 | | 11/1993 |
| JP | 6-12594 | | 3/1994 |
| JP | 2551754 | | 8/1996 |
| JP | 09-282992 | | 10/1997 |
| JP | 10-177833 | | 6/1998 |
| JP | 11-111135 | | 4/1999 |
| JP | 11-238440 | | 8/1999 |
| JP | 2001-049092 | | 2/2001 |
| JP | 2002-163966 | | 6/2002 |
| JP | 2003-317589 | | 11/2003 |
| JP | 2003-317590 | | 11/2003 |
| JP | 2003317589 | A * | 11/2003 |
| JP | 2004095524 | A * | 3/2004 |
| JP | 2004-119255 | | 4/2004 |
| KR | 2004-101534 | | 12/2004 |

* cited by examiner

THERMAL FUSE EMPLOYING A THERMOSENSITIVE PELLET

BACKGROUND OF THE INVENTION

1. Field of the Invention

The present invention relates generally to thermal fuses employing a thermosensitive pellet exploiting a characteristic in flowability of a thermosensitive material thermally deforming at an increased temperature to allow the fuse to operate precisely at a temperature, and particularly to thermal fuses employing a thermosensitive pellet using a thermosensitive material composed of a thermoplastic resin exhibiting a characteristic in flowability when it is softened or melted.

2. Description of Related Art

Thermal fuses are generally divided into two types depending on the thermosensitive material used. One is a thermal fuse employing a thermosensitive pellet using non-conductive thermosensitive material, and the other is a thermal fuse employing a low melting point fusible alloy of conductive thermosensitive material. They are both a so-called non-reset thermal switch. When its surrounding temperature increases and a prescribed temperature is reached, the fuse operates to cut off or electrically connect a current carrying path of equipment and an apparatus to protect them. The fuse operates at a temperature determined by the thermosensitive material used. Typically, it is offered commercially in products operating at a temperature ranging from 60° C. to 240° C. on a rated current ranging from 0.5 A to 15 A, and acts as an electrical protection component allowing an initial conducting or interrupt state for an initial ordinary temperature to be inverted at a predetermined operating temperature to provide an opposite interrupt or conducting state. Of the above thermal fuses, the thermal fuse employing a thermosensitive pellet is composed of a casing having opposite ends with a respective lead member attached thereto, and a pellet of a non-conductive thermosensitive material, a compression spring and a movable conductor accommodated in the casing. When a prescribed operating temperature is attained and the pellet softens or melts, the compression spring pushes and presses and thus acts on the movable conductor to move it to change a conducting or interrupt state or vice versa. The thermosensitive pellet is typically formed of a chemical agent having a prescribed melting point and formed into a prescribed geometry, granulated, made into a tablet and thus pelletized.

The thermal fuse employing a thermosensitive pellet generally employs a thermosensitive material composed of a single organic chemical compound having a known melting point, and to make it a thermosensitive pellet, binder, lubricant, pigment and the like are added to enhance granulability, provide uniform density and classify the type of the thermosensitive pellet, respectively, and the thus obtained medium is pelletized. The single organic compound includes 4methylumbelliferone, a pure chemical agent, as disclosed for example in Japanese Patent Laying-Open No. S60-138819. Furthermore, as disclosed in Japanese Patent Laying-Open No. 2002-163966 and Japanese Patent No. 2551754, two or more types of organic compounds may be mixed together to prepare and use a thermosensitive material having a different melting point. In general, a eutectic mixture is satisfactory in thermal stability and insulation stability. It is said, however, that if it is mixed with an intended chemical agent, its melting point varies. Furthermore, these chemical agents are low molecular weight compounds and are chemical agents such as certified pure reagents or other similar reagents of high purity. Furthermore, Japanese Utility Model Publication No. H6-12594 indicates a disadvantage associated with pelletization in connection with a thermosensitive pellet's insulation resistance when the pellet melts, and a resolution therefor.

Japanese Patent Laying-Open No. S50-138354 and Japanese Utility Model Laying-Open No. S51-145538 disclose a thermosensitive material composed of paraffin or a similar thermosensitive fusible substance or a heat resistant, non-conductive, synthetic resin material. However, either case is not practically used since it utilizes the melting of the thermosensitive material itself and there is a problem associated with setting an operating temperature that can be ensured, and the thermosensitive pellet's secular variation. Furthermore, Japanese Patent Laying-Open No. 2003-317589 discloses a thermal fuse employing a thermosensitive pellet that employs a thermosensitive material composed of thermoplastic resin blended with a filler. It is not easy for the thermal fuse, however, to set a highly precise and steady operating temperature.

SUMMARY OF THE INVENTION

For thermal fuses employing a thermosensitive pellet when a thermosensitive material is selected, the thermosensitive material is required to be readily pelletized and provide a significantly precise and steady operating temperature. For example, if a chemical agent is used as the thermosensitive material, the thermosensitive pellet at a high temperature close to its melting point reduces through sublimation, and in storage or use at high humidity melts and reduces through deliquescence. Either case can cause the thermal fuse to erroneously operate or cut off, failing to ensure steady operating temperature. Furthermore, the thermal fuse employing the thermosensitive pellet is affected by its environment and furthermore, as it is produced in a process for shaping powdery material, it is not strong and thus tends to crack or chip or have a similar defect. As such, it is thermally, physically and chemically insufficiently stable, and there is a demand for a thermosensitive material satisfactorily addressing such disadvantages, and improvement of its characteristics.

Furthermore, a thermal fuse which employs a thermosensitive material composed of thermoplastic resin and utilizes softening or melting as temperature increases still has a problem associated with a method of setting an operating temperature, i.e., its operating temperature varies significantly. In particular, there is no clear resolution for operation response speed of a thermosensitive material thermally deforming at increased temperature, which is, as well as the operating temperature's precision, an obstacle to practical use. Furthermore, it is still not clarified which physical property of thermoplastic resin over a wide range facilitates pelletization and ensures that the pellet thermally deforms at a prescribed operating temperature rapidly. Thus, which thermosensitive material should be selected still remains as a difficult issue to be addressed.

The present invention contemplates a thermal fuse employing a thermosensitive pellet that employs a thermosensitive material selected from a physical and chemical point of view to ensure that it operates at a prescribed temperature rapidly. More specifically, the present invention contemplates a thermal fuse employing a thermosensitive pellet that allows its operating temperature to be adjusted, can facilitate pelletization in its production process, alleviate its deterioration as a completed product in storage and use, and immediately respond to a prescribed operating temperature limited in variation.

Furthermore, the present invention contemplates a high precision thermosensitive thermal fuse that exploits the thermosensitive material's flowability. More specifically, it employs a thermosensitive material selected with a characteristic thereof in flowability considered so that it can operate reliably at a prescribed temperature. To address such issues, as the thermosensitive material, a thermoplastic resin is selected with reference to flowability, associated with it being appropriate for pelletization and having quick responsiveness of thermal deformation in operation. Furthermore, to achieve a highly precise and steady operating temperature, the operating temperature must have a minimized range in variation, and furthermore the thermosensitive pellet's sublimation and deliquescence must be minimized. To achieve this, the thermosensitive material's flowability at high temperature close to the operating temperature can be specified by a melt flow rate (MFR) according to a flowability characteristics measurement as defined by JIS K7210 to reduce the occurrence of products defectively cracking or chipping in pelletization and increase the operating temperature's precision and response speed to achieve improved insulation resistance and withstand voltage at high temperature.

The present thermal fuse employing a thermosensitive pellet includes a first lead member fixed at one opening of a metallic, cylindrical casing via an insulated bushing, a second lead member crimped and thus fixed at the other opening of the casing, and a switching function member accommodated in the casing, and the switching function member includes a thermosensitive pellet, a movable conductor engaged with the thermosensitive pellet, and a spring member pressing the movable conductor. At a prescribed operating temperature the thermosensitive pellet softens or melts to liberate the spring member from a load to cause the spring member to move the movable conductor to switch an electrical circuit located between the first and second lead members, and the thermosensitive pellet is formed of a thermosensitive material selected depending on a characteristic in flowability presented as it softens or melts.

Preferably the thermosensitive material is a thermoplastic resin having a characteristic in flowability of at least 0.5 g/10 min. more preferably at least 1.0 g/10 min., as represented in melt flow rate. Preferably the operating temperature is set between an extrapolated initial melting temperature and an extrapolated ending melting temperature of the thermoplastic resin and adjusted by force exerted by the spring member. Suitably the thermoplastic-resin is polyolefin having a degree of crystallinity of at least 20%. The thermal fuse can thus facilitate pelletization and reduce secular variation as well as minimize variation as a product to have a highly precise and steady operating temperature.

The present thermal fuse employing a thermosensitive pellet in another aspect includes: a switching function member including a thermosensitive pellet starting to melt at a temperature lower than a prescribed operating temperature as the thermosensitive pellet is heated and pressed, a movable conductor engaged with the thermosensitive pellet, and a spring member pressing the movable conductor; a cylindrical casing accommodating the switching function member; a first lead member fixed at one opening of the cylindrical casing and having a first electrode at an end thereof; and a second lead member fixed at the other opening of the cylindrical casing such that the cylindrical casing has an internal surface providing a second electrode therefor. The thermosensitive pellet deforms at the prescribed operating temperature to allow the spring member to move the movable conductor to switch between connecting and disconnecting the movable conductor to and from the first electrode to switch an electrical circuit between the first and second electrodes. The thermosensitive pellet is formed of a thermosensitive material composed of a thermoplastic resin having a characteristic in flowability of at least 0.5 g/10 min as represented in a melt flow rate.

Preferably the movable conductor has a contact contacting and detaching from the first electrode and a contact normally slidably contacting the second electrode and the spring member includes a weak compression spring and a strong compression spring with the movable conductor interposed therebetween, the strong compression spring being opposite the movable conductor and the thermosensitive pellet with respective pressure plates interposed therebetween. Preferably the thermosensitive material is a crystalline thermoplastic resin having a melt flow rate (MFR) of at least 1.0 g/10 min. and a degree of crystallinity of at least 20%, and an olefin resin or a polyolefin referred to as an olefin polymer is preferably used. The polyolefin generally refers to ethylene, propylene, butadiene, isoprene or similar olefin or diolefin, or a similar polymer or copolymer of aliphatic unsaturated hydrocarbon having a molecule with a double bond therein. The polyolefin includes polyethylene (PE), polypropylene (PP), polymethylpentene (PMP) and the like, and that which has a melt flow rate (MFR), which is associated with flowability when it softens or melts, falling within a particular range achieves an operating temperature limited in variation and hence significantly improved precision.

The thermosensitive material can be adjusted to have a desired operation characteristic(s) by mixing its base material with a variety of additives, reinforcement materials and fillers. Furthermore, if other than by selecting a main material, the operating temperature is adjusted by polymerizing, copolymerizing, plastifying or blending resin material, or synthesizing or purifying thermoplastic resin with a different catalyst, then the thermosensitive pellet's reduction in weight associated with deliquescence and sublimation can be reduced, withstand voltage characteristic(s) can be improved, and the pellet can be increased in strength to reduce a defect caused by cracking, chipping and/or the like. This allows the pellet to be produced by extrusion or injection molding so that a thermal fuse enhanced in workability and handleability can be provided. Such a thermal fuse can be produced inexpensively and can provide a quick response.

The thermosensitive pellet employs a thermosensitive material selected with a melt flow rate serving as an index for its characteristic in flowability. As such, a thermal fuse can be provided having a set operating temperature with limited variation between products, and hence having a high reliability. In contrast, for conventional thermosensitive materials, while they may have the same melting point, they may be a hard material or a soft material, and if they are slowly increased in temperature their respective operating temperatures provide significant variation. Furthermore, if temperature is rapidly increased, a difference in response time is disadvantageously provided. In contrast, the present thermosensitive material selected depending on a characteristic in flowability presented when it softens or melts, can provide a thermal fuse having an operating temperature with limited variation and achieving a small response time difference, and thus constantly presenting steady operation characteristics.

In particular, employing polyolefin having a degree of crystallinity of at least 20% can facilitate pelletization and provide a pellet having an improved strength. Furthermore, if the thermal fuse is placed in high humidity or the atmosphere or a toxic gas environment and time elapses, the thermal fuse can be stable and less erosive and thus prevent impaired insulation. Thus not only in storage but in use as well this thermal fuse can prevent impaired electrical and other characteristics, reduce secular variation, operate constantly and accurately at a prescribed operating temperature, and help to enhance stability and reliability and provide other similar practical effects.

The operating temperature of the present thermal fuse can be adjusted by the temperature at which the thermosensitive material thermally deforms, and the pressure exerted by a spring member composed of a strong compression spring and a weak compression spring combined together. More specifically, if the thermosensitive material is thermoplastic, then, with respect to a characteristic in flowability presented as the thermoplastic softens or melts, a melt flow rate in "A Method of Testing a Plastic-Melt Flow Rate (MFR) and a Melt Volume Flow Rate (MVR)" as defined in JIS K7210 is adopted as an index for selection. In particular, if the thermoplastic resin is polyethylene (PE), then an index of a melt flow rate (MFR) in "Material for Shaping and Extruding Plastic-Polyethylene (PE)—Second Section: How to Prepare a Test Piece and Obtain a Variety of Properties" as defined in JIS K6922-2 is utilized. Furthermore, for terminology such as extrapolated initial melting temperature employed as an index for indication when thermoplastic resin softens or melts, "extrapolated initial melting temperature (Tim) and extrapolated ending melting temperature (Tem)" based on a definition of JIS K7121 are used. As such, these terms used in the present invention are interpreted by their definitions by the JIS standards. The present invention can provide a thermal fuse employing a thermal pellet allowing an operating temperature to be set over a wide range, with limited variation, and operating rapidly with high precision.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
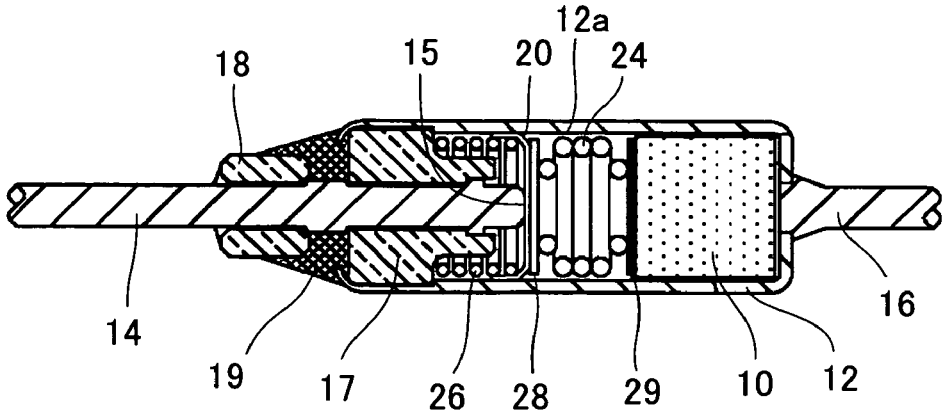
FIGS. 1A and 1B are cross sections of the present thermal fuse employing a thermosensitive pellet before and after operation, respectively.
Figure 1B:
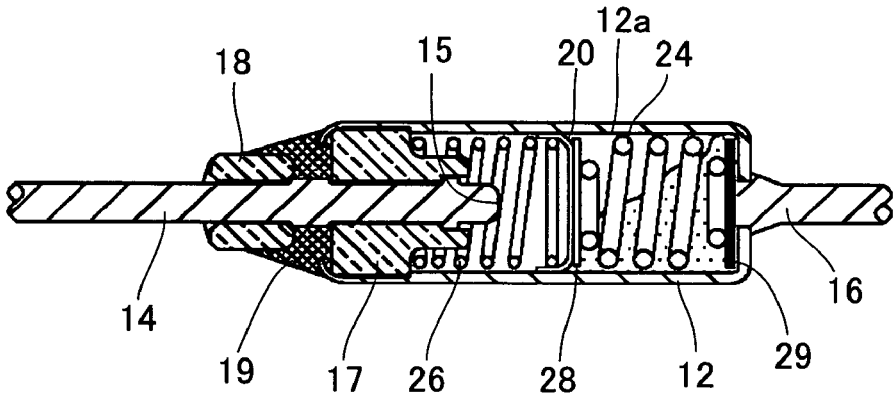

The present thermal fuse employing a thermosensitive pellet in a preferred embodiment, as shown in FIGS. 1A and 1B by way of example, includes a first lead member 14 fixed at one opening of a metallic, cylindrical casing 12 via an insulated bushing 17 by a resin seal 19, a second lead member 16 crimped and thus fixed at the other opening of casing 12, and a switching function member accommodated in casing 12. The switching function member includes a thermosensitive pellet 10, a movable conductor 20 engaged with thermosensitive pellet 10, and a spring member 24, 26 pressing movable conductor 20. In the present thermal fuse at a prescribed operating temperature thermosensitive pellet 10 softens or melts to liberate spring member 24, 26 from a load to cause spring member 24, 26 to move movable conductor 20 to switch an electrical circuit located between the first and second lead members 14 and 16.

When the thermosensitive pellet deforms, the spring member's compressive or tension force moves the movable conductor to electrically disconnect or connect and thus switch the electrical circuit. Thermosensitive pellet 10 is composed of a thermosensitive material characterized in that it is selected by a characteristic in flowability presented when it softens or melts. This can provide a thermal fuse employing a thermosensitive pellet having a highly reliable operating temperature and a high practical value. For such a point of view, a characteristic in flowability, as represented in melt flow rate, of at least 0.5 g/10 min is preferable, and that of at least 1.0g/10 min is more preferable. For the thermosensitive material, thermoplastic resin can preferably be used. In particular, polyolefin is preferable and, among others, polyolefin having a degree of crystallinity of at least 20% is more preferable. The operating temperature is preferably set between the thermoplastic resin's extrapolated initial melting temperature (Tim) and extrapolated ending melting temperature (Tem) and adjusted by force exerted by the spring member.

In the present invention the thermosensitive material or thermoplastic resin's characteristic in flowability is specified by melt flow rate (MFR), which is defined in JIS K7210 as a method of testing thermoplastic resin, and a condition, a temperature and the like for the test are determined depending on the plastic material of interest. For example, if the material is that for shaping and extruding polyethylene (PE) of JIS K6922 then it is tested at 190° C. For film-forming, a material having an MFR of approximately 0.01 to 0.1 is employed, although such material is poor in flowability, and for a thermosensitive material for extrusion or injection molding, a resin having an MFR of at least 0.1 is preferable. For example, as defined in JIS K7210, a testing apparatus is used that has a heater equipped cylinder having a length of 115 mm to 18 mm and an internal diameter of 9.55±0.025 mm and receiving a sample, and receiving a piston having an upper end with a weight attached thereto. The weight's load is set to be 3.19N and the amount (in grams) of the material extruded at a prescribed testing temperature for 10 minutes is measured.

Furthermore, of polyolefin serving as crystalline thermoplastic resin, polyethylene (PE) includes low-density polyethylene (LDPE), linear low-density polyethylene (LLDPE), high-density polyethylene (HDPE), ultrahigh molecular weight polyethylene (ultrahigh molecular weight PE), very low-density polyethylene (VLDPE), and, as a copolymer, a copolymer of ethylene and acrylic acid (EAA), a copolymer of ethylene and ethylacrylate (EEA), a copolymer of ethylene and methylacrylate (EMA), a copolymer of ethylene and glycidyl methacrylate (GMA), a copolymer of ethylene, methylacrylate and maleic anhydride, and the like. Furthermore, identical HDPEs are further classified by application, how they are shaped, and the like, and distinguished by application such as extrusion, injection, drawing, piping, filming and the like. Furthermore, materials having different MFRs for different applications, respectively, are also commercially available. For example, if high density polyethylene is injection molded into a pellet, using PE having an MFR of 5 to 50 g/10 min. is preferable.

In general, a material having an MFR smaller than 0.1 g/10 min. used for example for filming is poor in flowability, and using the material as the thermosensitive material results in a significantly varying operating temperature and difficult to develop for practical use. Furthermore the thermal fuse employing the thermosensitive pellet can utilize a spring's pressure to set an operating temperature, as desired, and the desired operating temperature can be adjusted, as desired, from the selected thermoplastic resin's melting point, and extrapolated initial melting temperature (Tim) and extrapolated ending melting temperature (Tem). Normally, for a low molecular weight compound, the smaller difference its peak melting temperature (Tpm) and extrapolated ending melting temperature (Tem) have therebetween, the more suitable it is for a material for a thermosensitive pellet for a thermal fuse. However, adopting extrapolated initial melting temperature (Tim) and peak melting temperature (Tpm) having a range to some extent (or a difference in temperature of at least 5° C.), and adjusting a value of a load exerted to press the thermosensitive pellet to set an operating temperature can provide an increased degree of freedom in setting the operating temperature. From such point of view, a thermosensitive pellet starting to melt or similarly deform at a temperature lower than a prescribed operating temperature, is employed.

Polyethylenes (PEs) are classified by density, as follows, and have different melting points depending on their respective densities, and provide an MFR of approximately 0.01 to 50 g/10 min.

LDPE: density: 0.910-0.935, melting point: 105-110° C.

HDPE: density: 0.941-0.965, melting point: 130-135° C.

Other than the above, there are LLDPE having a melting point of 120-130° C. and ultrahigh molecular weight PE having a melting point at 135-138° C., and for identical materials, their densities can be converted into temperature to obtain their melting points. It should be noted, however, that heat distortion temperature can be adjusted not only by a degree of polymerization but also mixing LDPE, HDPE, LLDPE or the like together, and reduced by adding plasticizer.

Furthermore there are also secondary materials for resin classified into three types: additive, reinforcement material, and filler. The additive generally includes antioxidant, thermostabilizer, photostabilizer, nucleus creator, compatibilizer, colorant, an antimicrobial agent, an antifungal agent, lubricant, and a foaming agent. Of these, important are the anti-oxidant, the thermostabilizer, the nucleus creator as it provides an increased degree of crystallinity, and the colorant as it identifies a temperature range. The reinforcement material includes mica, calcium carbonate, glass fiber, carbon fiber, aramid fiber and the like, and these can be added for example when the thermosensitive pellet in a copolymer or an elastomer softens more than required or despite high temperature the thermosensitive pellet's physical dimensional stability needs to be maintained. The filler includes talc, clay, calcium carbonate and similar extender. Note that the extender is introduced into the resin to minimize the cost for the source material(s) of the resin. Furthermore, there are also flame retarder helping the resin to be less burnable, and an antistatic agent preventing the resin from storing electricity. Such secondary materials can be blended as appropriate.

First Embodiment

In the present embodiment a thermal fuse employing a thermosensitive pellet, as shown in FIGS. 1A and 1B, is fabricated. FIG. 1A is a cross section thereof at room temperature in a normal condition before operation, and FIG. 1B is a cross section thereof at increased temperature in an abnormal condition after operation. For the thermosensitive material, high density polyethylene (having a melting point of approximately 132° C.), a polyolefin, is used. It is formed into thermosensitive pellet 10 and accommodated in metallic, cylindrical casing 12 having one opening with the first lead member 14 fixed thereto and the other opening with the second lead member 16 crimped and thus fixed thereto. The first lead member 14, fixed via an insulating bushing 17, is insulated from casing 12 and thus extends therein, and has an end provided with a first electrode 15. Furthermore, the first lead member 14 has an externally guided portion provided with an insulated bushing 18 for protection fixed with resin seal 19 at an opening of casing 12. The second lead member 16 is crimped directly and thus fixed in connection with casing 12 and an internal surface of casing 12 serves as a second electrode 12*a*.

Casing 12 also accommodates a switching function member including thermosensitive pellet 10, movable conductor 20, and spring member 24, 26. Movable conductor 20 has a contact contacting and detached from the first electrode 15, and a contact normally slidably conducting the second electrode 12*a*. The contact connecting and detached from the first electrode is preferably a center contact for electrical connection increased in stability. Furthermore, movable conductor 20, which point-contacts the second electrode 12*a* of the internal surface of casing 12, is preferably a member in the form of a star as it can smoothly slide to ensure reliable electrical conduction. The spring member includes strong compression spring 24 and weak compression spring 26. At room temperature, as shown in the FIG. 1A example, strong compression spring 24 larger in resilience than weak compression spring 26 presses and thus causes movable conductor 20 to contact the first electrode 15. In particular, it is preferable that strong compression spring 24, and movable conductor 20 and thermosensitive pellet 10 sandwich pressure plates 28 and 29, respectively, as such arrangement can facilitate assembling and also allow the spring to provide stable operation.

In abnormal condition when a prescribed operating temperature is attained, then, as shown in the FIG. 1B example, the thermosensitive pellet softens or melts and deforms to liberate the spring member from a load and weak compression spring 26 exerts force to press and thus move movable conductor 20. Strong compression spring 24 is liberated beyond its stroke range. Accordingly, weak compression spring 26 pushes movable conductor 20 within its stroke range, and movable conductor 20 slides on the second electrode 12*a* located at the internal surface of casing 12. Movable conductor 20 thus moved is disconnected from the first electrode 15 to switch off an electrical circuit located between the first and second lead members 14 and 16. Note that while FIGS. 1A and 1B show the thermal fuse employing the thermosensitive pellet normally turned on and turned off for abnormality by way of example, for some arrangement and configuration of the spring member it is also possible to provide a thermal fuse employing a thermosensitive pellet operating vice versa, i.e., normally turned off and turned on for abnormality, and such thermal fuse employing the thermosensitive pellet is also encompassed in the present invention's technological scope.

In the present embodiment, thermosensitive pellet 10 is formed of a thermosensitive material implemented by high density polyethylene (HDPE) available from Japan Polyethylene Corporation and having a melt flow rate (MFR) of 2.0 g/10 min. and a melting point of approximately 132° C.

Figure 2:
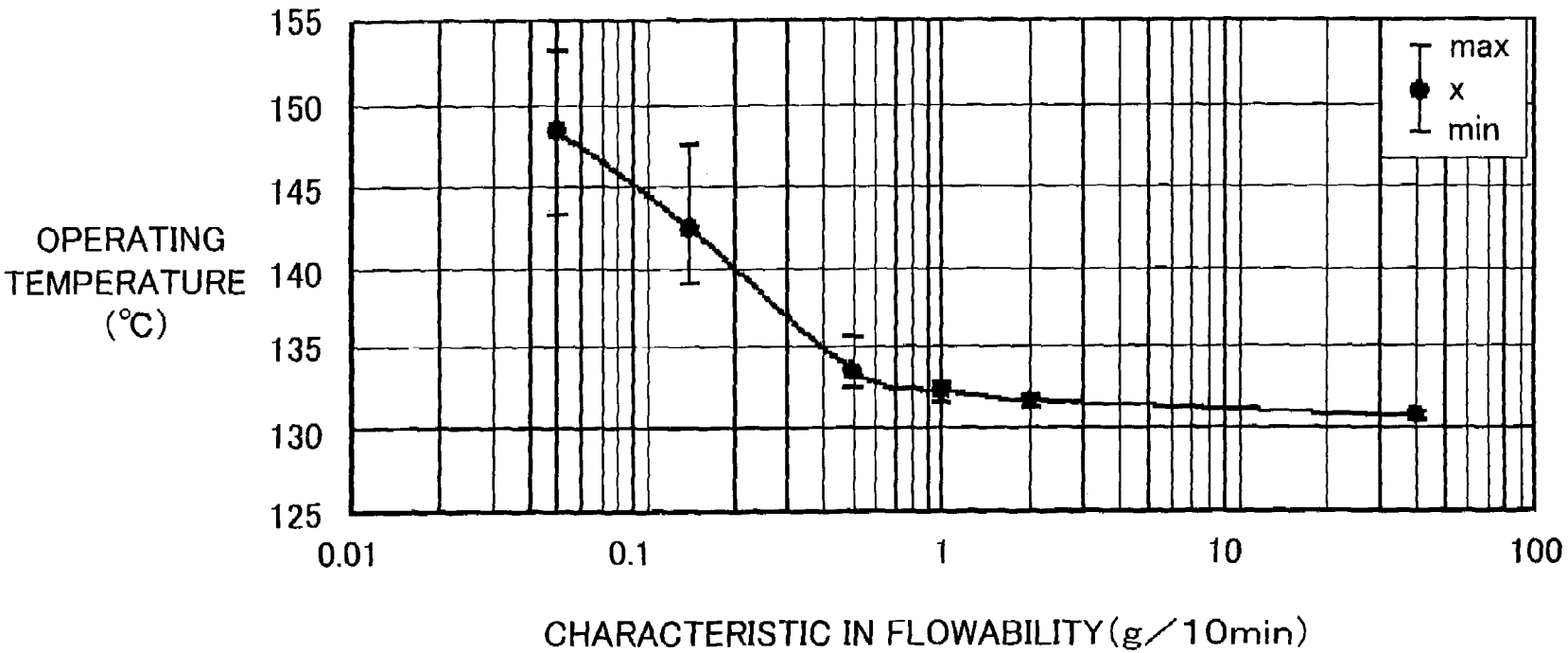
FIG. 2 represents a relationship between a characteristic in flowability of a thermosensitive material used in the present thermal fuse and its operating temperature.

Furthermore, this HDPE has types for filming, injection molding, extrusion molding and the like depending on different applications and a variety of types of products thereof is commercially available. Of such HDPEs, HDPEs different in melt flow rate (MFR) were selected and used to fabricate prototype thermal fuses. More specifically, six types of HDPEs having MFRs of 0.05 g/10 min., 0.14 g/10 min., 0.5 g/10 min., 1.0 g/10 min., 2.0 g/10 min., and 40 g/10 min. were selected and used to fabricate six groups of prototype thermal fuses employing different thermosensitive pellets. Then for each group, 10 prototype products had their respective operating temperatures measured to obtain a maximum operating temperature max, a minimum operating temperature min, an average operating temperature $\bar{x}$ and a variation range R, as shown in Table 1. Furthermore, FIG. 2 represents a relationship between the thermosensitive material's characteristic in flowability and operating temperature as based on the obtained measurement.

TABLE 1

| | Operating Temperature (° C.) | | | |
|---|---|---|---|---|
| Characteristic in Flowability (MFR) <g/10 min.> | Maximum Value (max) | Average Value ($\bar{x}$) | Minimum Value (min) | Variation (R) |
| 0.05 | 153.2 | 148.4 | 143.3 | 9.9 |
| 0.14 | 147.5 | 142.5 | 139.0 | 8.5 |
| 0.5 | 135.6 | 133.5 | 132.5 | 3.1 |
| 1.0 | 132.7 | 132.3 | 131.6 | 1.1 |
| 2.0 | 132.0 | 131.7 | 131.3 | 0.7 |
| 40 | 131.0 | 130.8 | 130.5 | 0.5 |

Typically it is said that an operating temperature is satisfactorily reliable if its variation range R is within 4° C. (±2° C.). As such, for an operating temperature of approximately 132° C., four types of MFRs of 0.5 g/10 min., 1.0 g/10 min., 2.0 g/10 min. and 40 g/10 min. fall within a range for practical use. As is also apparent from this result, for HDPE, in connection with flowability an MFR of at least 0.5 g/10 min. is preferable and an MFR of at least 1.0 g/10 min is more preferable. Furthermore, temperature is increased at different rates of 1° C./min. and 2° C./min. to similarly test and measure an operating temperature. Such measurement did not contribute to a significant difference.

As is apparent from Table 1 and FIG. 2, a thermosensitive material of high density polyethylene (HDPE) with an MFR less than 0.5 g/10 min., i.e., 0.14 g/10 min. and 0.05 g/10 min., provides an operating temperature having an average value $\bar{x}$ rapidly increasing, and increased variations Rs, exceeding a variation R±2° C. to ±3° C. corresponding to a limit for practical use. More specifically, it has been found that for HDPE having a melting point indicated by 132° C., a thermal fuse employing a thermosensitive pellet using a thermosensitive material having an MFR of less than 0.5 g/10 min. has a problem for practical use. In contrast, the four types with MFRs of 0.5 g/10 min. or larger allow a steady operating temperature and small variation R, found to allow a thermal fuse employing a thermosensitive pellet to operate with high precision. In particular, it has been found that an MFR of 1.0 g/10 min. or larger allows operation with a precision of approximately 1° C. (±0.5° C.), allowing a highly reliable operating temperature and thus having a significantly practical value.

When the thermoplastic material is composed of a crystalline thermoplastic resin, a polyolefin can suitably be used and can be selected from polyethylene (PE), polypropylene (PP), polymethylpentene (PMP) and the like. Furthermore, the thermosensitive material can be adjusted by employing crystalline thermoplastic resin, adopting a material melting or softening at a prescribed temperature as a base, and adding a variety of additives, reinforcement materials or fillers to the base to obtain desired operating characteristics. For example, if other than by selecting a main material, an operating temperature is adjusted by polymerizing, copolymerizing, plasticizing or blending a resin material, or synthesizing or purifying a thermoplastic resin with a different catalyst, then the thermosensitive pellet's reduction in weight associated with deliquescence and sublimation can effectively be reduced, withstand voltage characteristic(s) can be improved, and increased strength can be provided to reduce cracking, chipping and other similar defect. Furthermore, the thermosensitive pellet can be produced by injection extrusion or molding so that a thermal fuse enhanced in workability and handleability, and produced inexpensively and providing a significantly faster response, can be provided.

The spring member, or strong compression spring 24 and weak compression spring 26, allows an operating temperature to be adjusted by exerting a modified load to press thermosensitive pellet 10 when it is heated to a temperature at which it thermally deforms. For example, if the spring member exerts loads having three different values of 2.25N, 2.88N and 3.04N, respectively, the larger the load is, the lower the operating temperature is. A result of testing the prototypes showed that although it depends on the MFR selected and the rate adopted to increase temperature, for a thermosensitive material having an MFR of 2.0 g/10 min. and a rate of 1° C./min adopted to increase temperature, changing a load of 2.25N to 3.04N can decrease an operating temperature in a range of approximately 1° C. Thus changing a load exerted on the thermosensitive pellet can adjust an operating temperature. Note that the thermosensitive pellet is pressed by strong compression spring 24 and weak compression spring 26 pressed via movable conductor 20. In the present embodiment, except that a thermosensitive pellet is composed of a selected thermosensitive material, a prototype having a structure similar to that of SEFUSE®, a thermal fuse employing a thermosensitive pellet commercially available from NEC SCHOTT Components Corporation, was evaluated.

Metallic, cylindrical casing 12 formed of copper, brass or similar satisfactory thermal conductor has opposite ends having openings, respectively, with the first and second lead members 14 and 15 attached thereto, respectively. Metallic, cylindrical casing 12 accommodates a switching function component including a thermosensitive pellet, movable conductor 20 formed of silver alloy and having a center and a perimeter provided with a contact, and spring member 24, 26 including strong and weak compression springs. The thermosensitive pellet is composed mainly of thermoplastic resin thermally deforming at a specific temperature under pressure of spring members, and the pellet is shaped and adjusted to provide an operating temperature as desired. A thermosensitive material thermally deforming at a prescribed operating temperature is selected depending on the melt flow rate (MFR), and a thermosensitive material having an MFR of 0.5 g/10 min. or larger is employed. MFR is determined from a conclusion obtained by conducting a test and obtaining a measurement using polyethylene (PE) different in MFR with respect to a relationship between the thermosensitive material's characteristic in flowability and an operating temperature.

When an operating temperature is set with a thermoplastic resin being used, even a thermosensitive material having a large temperature difference T between extrapolated initial melting temperature (Tim) and peak melting temperature (Tpm) is not recognized as affecting operating precision, and larger T facilitates setting an operating temperature. Furthermore, selecting an MFR value indicative of flowability of the thermosensitive material and selecting the spring member's spring pressure can also be utilized to set an operating temperature. As such, an operating temperature is set between the extrapolated initial melting temperature (Tim) and the extrapolated ending melting temperature (Tem) of the thermoplastic resin serving as the thermosensitive material, and simultaneously by the MFR associated with flowability and the spring member's spring force the operating temperature can be adjusted. Such a procedure is preferable in that it can provide an increased degree of freedom of setting an operating temperature.

Then, how a crystalline thermoplastic resin's degree of crystallinity has an effect on operating temperature was investigated. The crystalline thermoplastic resin used was polyethylene (PE) having an MFR of 2.0 g/10 min. Seven types of thermosensitive material providing different degrees of crystallinity of 10% to 80% were used as samples and incorporated into SEFUSE®, a thermal fuse employing a thermosensitive pellet produced by NEC SCHOTT Components Corporation, as has been previously described, to measure an operating temperature. For each type, ten prototypes were measured and therefrom their respective differences in temperature between maximum and minimum operating temperatures were determined and compared as variation (R) in operating temperature. A result thereof is shown in Table 2. As is apparent from Table 2, the selected thermosensitive material has a degree of crystallinity preferably of at least 20%, more preferably at least 40% in that it allows an operating temperature to be reduced in variation.

TABLE 2

| Degree of Crystallinity of Thermosensitive Material (%) | Variation of Operating Temperature |
|---|---|
| 10 | 14.3 |
| 15 | 8.3 |
| 20 | 3.9 |
| 25 | 3.3 |
| 40 | 1.8 |
| 60 | 1.5 |
| 80 | 1.1 |

Thus as a preferable embodiment of the present invention, for example, as shown in FIGS. 1A and 1B, there is provided a thermal fuse employing a thermosensitive pellet including: a switching function member having thermosensitive pellet 10 starting to melt at a temperature lower than a prescribed operating temperature as it is heated and pressed, movable conductor 20 engaged with thermosensitive pellet 10, and spring member 24, 26 pressing movable conductor 20; a cylindrical casing 12 accommodating the switching function member; the first lead member 14 fixed at one opening of cylindrical casing 12 and having the first electrode 15 at an end thereof; and the second lead member 16 fixed at the other opening of cylindrical casing 12 such that cylindrical casing 12 has an internal surface providing the second electrode 12*a* therefor, wherein thermosensitive pellet 10 deforms at the prescribed operating temperature to allow spring member 24, 26 to move movable conductor 20 to switch between connecting and disconnecting movable conductor 20 to and from the first electrode 15 to switch an electrical circuit between the first and second electrodes 15 and 12*a*, and wherein the thermosensitive pellet 10 is formed of a thermosensitive material composed of a thermoplastic resin having a characteristic in flowability of at least 0.5 g/10 min. as represented in melt flow rate.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermal fuse comprising: a first lead member fixed at a first opening of a metallic, cylindrical casing via an insulated bushing, a second lead member crimped and thus fixed at a second opening of said casing, and a switching function member accommodated in said casing, wherein said switching function member includes a thermosensitive pellet, a movable conductor engaged with said thermosensitive pellet, and a spring member pressing said movable conductor, wherein said thermosensitive pellet is adapted to soften or melt at a prescribed operating temperature so as to liberate said spring member from a load so that said spring member can move said movable conductor to switch an electrical circuit provided between said first and second lead members, wherein said thermosensitive pellet is formed of a thermosensitive material selected depending on a characteristic in flowability presented as said thermosensitive material softens or melts, and wherein said thermosensitive material is a thermoplastic resin having said characteristic in flowability of at least 0.5 g/10 min. as represented in a melt flow rate.

2. The thermal fuse according to claim 1, wherein said operating temperature is set between an extrapolated initial melting temperature and an extrapolated ending melting temperature of said thermoplastic resin and said operating temperature is further adjusted by a level of force exerted by said spring member.

3. The thermal fuse according to claim 1, wherein said thermoplastic resin is a polyolefin having a degree of crystallinity of at least 20%.

4. A thermal fuse comprising:

a switching function member including a thermosensitive pellet adapted to start to melt at a temperature lower than a prescribed operating temperature as said thermosensitive pellet is heated and pressed, a movable conductor engaged with said thermosensitive pellet, and a spring member pressing said movable conductor;

a cylindrical casing accommodating said switching function member;

a first lead member fixed at a first opening of said cylindrical casing and having a first electrode at an end thereof; and a second lead member fixed at a second opening of said cylindrical casing such that an internal surface of said cylindrical casing provides a second electrode therefor;

wherein said thermosensitive pellet is adapted to deform at said prescribed operating temperature to allow said spring member to move said movable conductor to switch between connecting and disconnecting said movable conductor to and from said first electrode to switch an electrical circuit provided between said first and second electrodes, said thermosensitive pellet is formed of a thermosensitive material composed of a thermoplastic resin having a characteristic in flowability of at least 0.5 g/10 min. as represented in a melt flow rate, said movable conductor has a first contact selectively contacting and detaching from said first electrode and a second contact normally slidably contacting said second electrode, and said spring member includes a weak compression spring and a strong compression spring arranged with said movable conductor interposed therebetween and with said strong compression spring being between said movable conductor and said thermosensitive pellet with respective pressure plates interposed respectively therebetween.

* * * * *

UNITED STATES PATENT AND TRADEMARK OFFICE

CERTIFICATE OF CORRECTION

PATENT NO. : 7,330,098 B2 
APPLICATION NO. : 11/203079
DATED : February 12, 2008
INVENTOR(S) : Yoshikawa It is certified that error appears in the above-identified patent and that said Letters Patent is hereby corrected as shown below:

On the cover page,

Item [*] Notice: Subject to any disclaimer, the term of this patent is extended or adjusted under 35 USC 154(b) by (211) days Delete the phrase "by 211 days" and insert --by 182 days--;

Title page,
Page 2, Column 1, Line 21, after "11/2003", replace "Merfled" by --Merfeld--;

Column 1,
Line 56, replace "4methylumbelliferone" by --4-methylumbelliferone--;

Column 3,
Line 50, after "the", replace "thermoplastic-resin" by --thermoplastic resin--;

Column 10,
Line 47, after "and", replace "15" by --16--.

Signed and Sealed this

Sixteenth Day of June, 2009

JOHN DOLL
*Acting Director of the United States Patent and Trademark Office*